United States Patent [19]

Hynson

[11] 4,183,529

[45] Jan. 15, 1980

[54] FOOTBALL GAME

[76] Inventor: Charles D. Hynson, 507 N. Roosevelt, Sand Springs, Okla. 74063

[21] Appl. No.: 920,659

[22] Filed: Jun. 30, 1978

[51] Int. Cl.[2] ..... A63F 3/00; A63F 7/06

[52] U.S. Cl. ..... 273/94 R; 273/247

[58] Field of Search ..... 273/94 R, 259, 247, 273/277

[56] References Cited

U.S. PATENT DOCUMENTS

| | | | |
|---|---|---|---|
| 2,205,415 | 6/1940 | Keely et al. | 273/94 R |
| 3,103,361 | 9/1963 | Board | 273/94 R |
| 3,947,039 | 3/1976 | Sadler et al. | 273/94 R X |
| 4,003,580 | 1/1977 | Haffey | 273/94 R X |

FOREIGN PATENT DOCUMENTS

| | | | |
|---|---|---|---|
| 411511 | 6/1934 | United Kingdom | 273/247 |

*Primary Examiner*—George J. Marlo
*Attorney, Agent, or Firm*—Head & Johnson

[57] ABSTRACT

A board game for the playing of a simulated football game with one or more players and comprising a board having a football playing field inscribed thereon for the playing of the game, a plurality of defense instruction cards and offense instruction cards stored on the board for individual selection, if desired, during the playing of the game, a play result tabulation table inscribed on the game board for cooperating with a plurality of offense style cards and defense style cards for determining the results of each play of the game. At the outset the player or players determine a particular offense style to be used throughout the game, and a die is cast to determine the player to start the game. Each game starts by placing a player token on the twenty yard line indicated on the football playing field provided on the game board, and the team in control of the ball will be on the offense and the other team will be on defense. The player representing the offensive team may select a play of his own or may use predetermined plays of the instruction cards, and the player representing the defensive teams selects a proper defense instruction card. The offense and defense style cards corresponding to the play are each placed in the proper place on the tabulation table, and a direct reading corresponding to the two co-acting plays is taken from the table to determine the end result of the play. The player token is moved on the football field according to the play result, and the action is repeated until a complete game has been played.

10 Claims, 12 Drawing Figures

28

DEFENSE STYLE

68

| | | | | | |
|---|---|---|---|---|---|
| | | | | | P.F. |
| 5 | 11 | 4 | -3 | 16 | 18 |
| 8 | TD | 30 | INC | 13 | FUM |
| 3 | 2 | 3 | 1 | 1 | 2 |
| | | | O.S. | | |
| -5 | 17 | 6 | 12 | 9 | 9 |
| 21 | 5 | 10 | INC | 31 | TD |
| 5 | -2 | 6 | 5 | 2 | 3 |
| -8 | 16 | 13 | 10 | 15 | 4 |
| 0 | 14 | INC | 4 | 8 | 10 |
| -2 | 9 | -3 | 8 | 7 | TD |
| 6 | 17 | 31 | 12 | 10 | 10 |
| TD | TD | INC | INC | 64 | 39 |
| | | INT. | | | FUM. |
| TD | TD | 25 | INC | 61 | 8 |
| | | | | | FUM. |
| 6 | 7 | -4 | 4 | 3 | 4 |
| -13 | 0 | 6 | 3 | -1 | 11 |
| | | O.S. | | | |
| INC | 42 | 2 | 35 | TD | 32 |
| 2 | 3 | 31 | 5 | 4 | 4 |
| -11 | 10 | 0 | 14 | 19 | 21 |
| | | | INT. | P.F. | |
| 2 | 10 | 17 | 14 | 15 | 7 |
| 4 | 21 | 2 | 2 | O.S. | 2 |
| 6 | O.S. | 3 | INC | TD | 29 |

14

| | | | | |
|---|---|---|---|---|
| 22 | 3 | 0 | 8 | 10 |
| INT. | INT. | | | |
| 8 | 15 | INC | -2 | 20 |
| 52 | 0 | 6 | 10 | 3 |
| 3 | 4 | 8 | 3 | 8 |
| P.F. | P.F. | | | |
| O.S. | INC | 6 | -12 | 10 |
| 31 | 3 | 2 | 2 | 5 |
| 7 | 4 | -2 | -7 | 0 |
| 12 | -8 | 0 | INC | 8 |
| | | | FUM. | |
| 14 | 5 | 0 | 0 | -2 |
| 6 | -3 | 8 | 0 | -30 |
| O.S. | | | | |
| INC | 14 | 25 | 6 | -12 |
| INT. | FUM. | | O.S. | |
| 20 | 12 | 3 | 46 | 32 |
| 21 | -4 | -8 | 20 | 6 |
| 82 | 4 | 2 | 62 | 6 |
| TD | 2 | 6 | -11 | D.H. |
| | | | P.F. | P.I. |
| 20 | 2 | 2 | -1 | 11 |
| | | | P.F. | |
| 13 | 13 | 12 | 20 | 2 |
| 22 | 8 | -8 | -6 | 15 |
| 21 | 2 | 1 | 1 | INC |
| 12 | 16 | -5 | 10 | 1 |

60

OFFENSE STYLE

30

*Fig. 2*

FOOTBALL GAME

BACKGROUND OF THE INVENTION

1. Field of the Invention

This invention relates to improvements in board games and more particularly, but not by way of limitation, to a simulated football game played on a game board by one or more players.

2. Description of the Prior Art

Game boards are in widespread use today for playing a great variety of games. Many game boards are directed toward amusements resembling football games, and whereas these games may be entertaining, many of them are either extremely complicated to learn, or the actual playing of the game is usually quite different or remote from the actual game of football as it is played on the football field. As a result, these games frequently fall short of the expectations of persons who truly enjoy football and are football "fans".

SUMMARY OF THE PRESENT INVENTION

The present invention contemplates a board game for playing a simulated football game which is very closely related to or resembles the actual plays used on the normal football field. The game board is provided with a football field inscribed thereon substantially corresponding to the usual football field and upon which the game is played. A tabulation table is also inscribed on the game board for providing a direct reading of the end result of each combination of offensive and defensive plays occurring during the playing of the game. The player or players may use their own strategy and game plans, or may select from a plurality of offense instruction cards provided with the game board. In addition, a plurality of defense instruction cards are provided with the game board, and the offense instruction cards and defense instruction cards are placed face down on the properly designated positions on the game board during the playing of the game. In the event the player chooses to select his own game strategy or game plan, suitable blank play instruction cards are provided upon which the player's strategy may be recorded prior to the initiating of the playing of the game. These cards may then be placed face down on the game board in lieu of the pre-printed cards supplied with the game. The defensive plays, however, remain the same and must be used from the pre-printed defense instruction cards provided with the game. In addition, a plurality of offense style cards and defense style cards are provided for use on the game board during the playing of the game. These style cards are utilized in combination with a tabulation table provided on the game board for determining the outcome or end result of each play of the game.

The game may be played by one or more players with substantially equal game interest or amusement. In the event a single player is playing the game, the player represents both the offensive and defensive teams, and in the event two players are playing the game, one player represents one team (which is alternately the offensive and defensive team) and the other player represents the opposing team in the football game.

At the beginning of each game, each player must determine the style offense to be used by his team throughout the game. These plays are then recorded individually on blank cards provided with the game, shuffled, and placed face down in a pile on the properly designated position on the game board. Of course, if desired the player may elect to use the pre-printed play instruction cards provided with the game in lieu of using his own game strategy. In this event the pre-printed instruction cards for offense are shuffled and placed face down in a pile on the game board. The defense play instruction cards, which are pre-printed cards, are also placed face down in a pile and deposited on the properly designated position on the game board, and whereas the offense instruction cards are shuffled only once at the beginning of a game, the defense instruction cards are reshuffled after each series of plays. Whenever the player is using the pre-printed offense instruction cards, defensive plays are limited to approximately nine pre-catagorized plays, and the pre-printed cards must be used. In a single player game, the player is not limited by any of the instruction cards, but is limited only by the play style cards.

A die is cast to determine the team to start the play and each game session starts by placing a player token on the twenty yard line indicated on the football playing field of the game board. It is preferable that each game comprise four quarters, as in actual football, and that each game comprise a limited or preselected number of total plays by each team, as for example fourteen plays per team, in order to provide a termination point for the game. As in actual football, the team in control of the ball at each play is on the offense, and the opposing team is on the defense. The player representing the offensive team at each play selects the top card of the offense instruction card pile, whether it is his own written card or the pre-printed card, and must follow the instructions found on the selected card. The player representing the defensive team selects the top card of the pre-printed defense instruction cards and must follow the instructions thereon. The offense team player then selects the pre-printed offense style card corresponding to his initially determined offensive strategy and places the style card in the proper position on the tabulation table provided on the game board. At the same time, the defensive player selects the defense style card corresponding to his selected defense play and places the defense style card on the designated position on the tabulation table. The location on the tabulation table at the intersection of the columns of the table which are in alignment with the offense style designation and the defense style designation provides a readout of the end result of the combination of the offense and defense, which provides the result of the play. The player token is then moved in accordance with the instructions read from the tabulation table for a new position on the football field inscribed on the game board to establish a new line of scrimmage for the next play. The plays may be repeated until an entire game has been played. The game strategy used during the play of the game closely resembles the play strategy utilized during an actual football game, thus providing a great similarity between the actual playing of a football game with the playing of the novel game on the game board.

BRIEF DESCRIPTION OF THE DRAWINGS

FIG. 2 is an enlarged view of the game result tabulation table utilized in the playing of a football game embodying the invention.

DESCRIPTION OF THE PREFERRED EMBODIMENT

Figure 1:
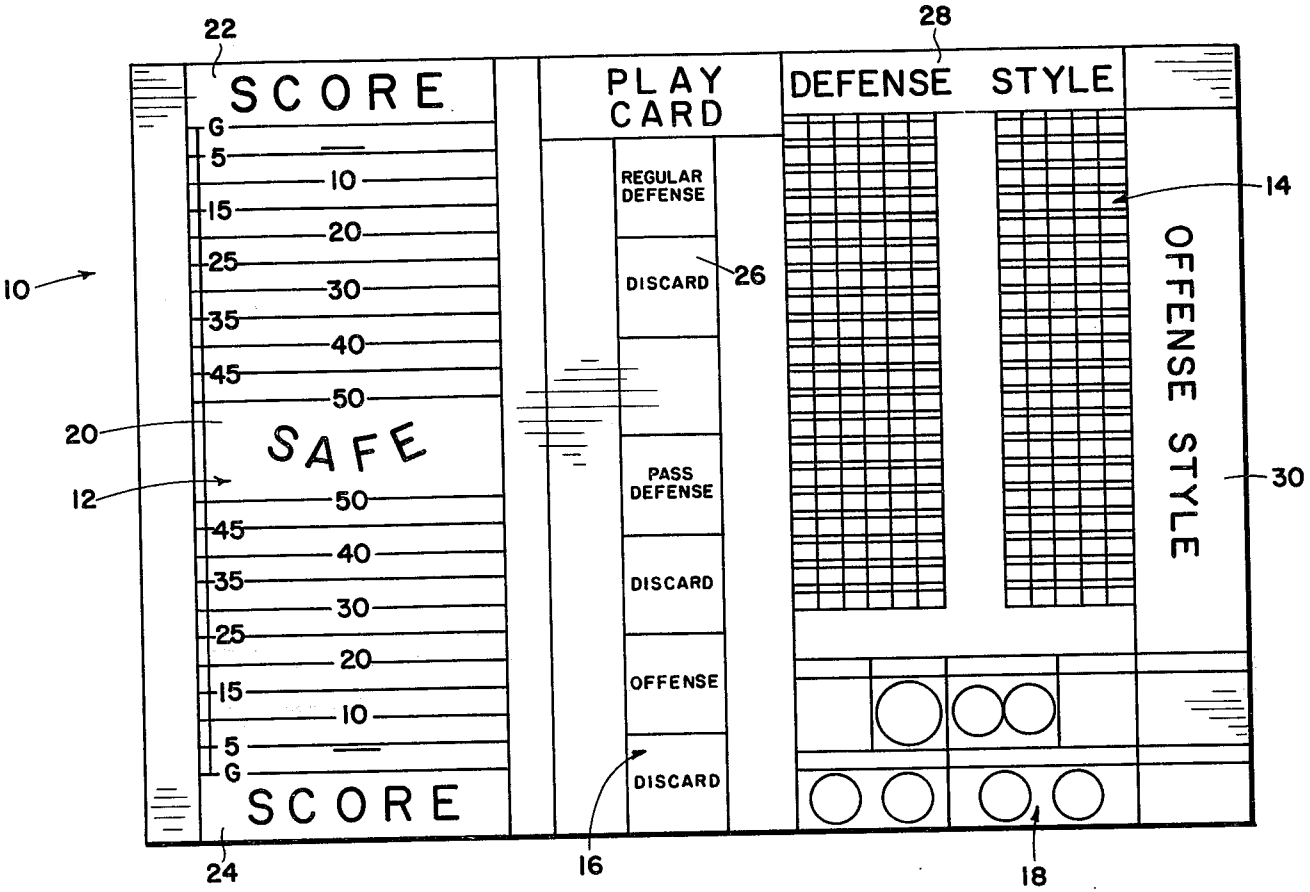
FIG. 1 is a plan view of a game board for a football game embodying the invention with portions of the indicia eliminated for purposes of illustration.

Referring to the drawings in detail, reference character 10 generally indicates a game board comprising a first section 12 inscribed thereon in any suitable manner to closely resemble a football playing field. A second section 14 is also inscribed on the face of the game board and is suitably inscribed to define a tabulation table which is utilized during the playing of the game for determining the ultimate outcome or end result of each play of the game, as will be hereinafter set forth. Third section 16 is also insribed on the face of the game board for indicating the position for the placement of suitable game playing cards utilized during the playing of the game. Whereas the sections 12, 14 and 16 may be arranged on the face of the game board in substantially any desired manner as shown herein the section 12 is preferably disposed in the proximity of one end of the board, the section 14 is disposed in the proximity of one end of the board, the section 14 is disposed in the proximity of the opposite end of the board, and the section 16 is interposed therebetween. In addition, a third section 18 is suitably inscribed on the face of the game board for providing a scoreboard area thereon, and as shown herein is preferably disposed in the proximity of the section 14, but not limited thereto.

The football field section 12 may be inscribed in any desired manner to simulate a football playing field, and as shown herein comprises a substantially centrally disposed area 20 designated as "Safe" with a plurality of mutually parallel lines representing the yard lines of an actual football playing field extending in spaced relation from the opposite sides thereof. Each end of the field section 12 is provided with an area 22 and 24, respectively, indicated "Score", and each represents the goal area of the actual football playing field. The spaced lines extending from the "Safe" area 20 are preferably identified with the yardage that the corresponding lines of the actual football playing field would carry, as particularly shown in FIG. 1. A suitable player token (not shown), such as a small statuette representative of a football player, is preferably utilized during the playing of the game, and is positioned on the playing field 12 in accordance with the football plays of the game, as will be hereinafter set forth.

The section 16 is preferably provided with a plurality of end-to-end sections 26 of a configuration complementary to the configuration of instruction playing cards (not shown) utilized during the playing of the game. For example, a plurality of cards (not shown) are provided for use in connection with offensive plays, and these cards are imprinted or inscribed with instructions setting forth the names or types of offensive football plays normally used during the playing of a regular or usual football game. Each of the offense instruction cards is printed with a different offense instruction, and during the playing of the game these cards are placed face down in a common pile on the section 26 entitled "Offense" in FIG. 1. Once one of the offense instruction cards has been picked up from the pile and used for a play, it is placed on one of the sections 26 which is in abuttment with the "Offense" section and which is entitled "Discard". Another section 26 is entitled "Regular Defense", and a pile of defense instruction cards similar to the offense instruction cards is placed on this section during the playing of the game. These "regular defense" cards preferably are imprinted with instructions relating to common defense plays used in the playing of a regular football game, and each card contains a different defense instruction. As the "regular defense" cards are picked up from the pile of cards, and has been used during a play, it is then placed on the section entitled "Discard" which is provided in abuttment with the "Regular Defense" section. Another of the sections 26 is entitled "Pass Defense" and a plurality of defense instruction cards containing plays normally used for defense against offensive pass plays are imprinted on the "pass defense" instruction cards. The "pass defense" instruction cards are placed, face down, in a pile on the Pass Defense section and when a pass defense instruction card has been used, it is placed on the "Discard" section 26 in abuttment with the "Pass Defense" section. The instruction cards are utilized for the selection of the game or play strategy during the playing of the game, as will be hereinafter set forth.

Figure 3:
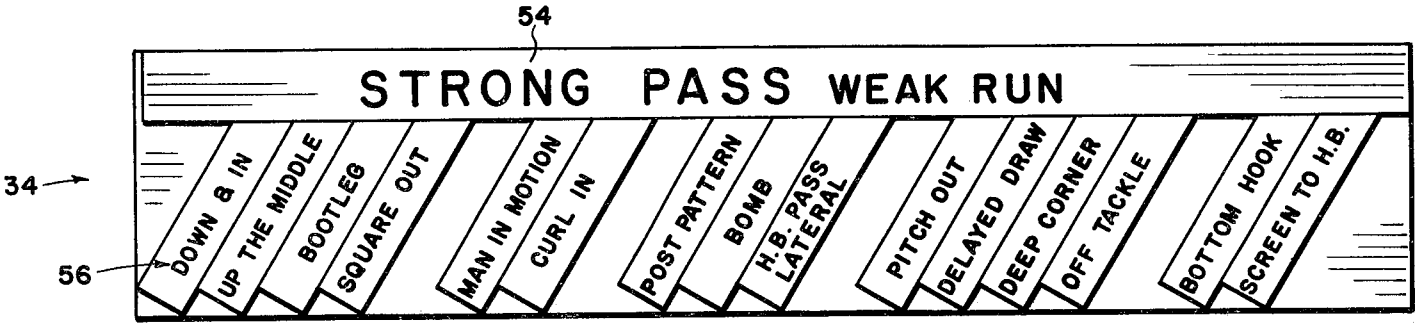
FIG. 3 is an enlarged view of an offense style card utilized in a football game embodying the invention.
Figure 4:
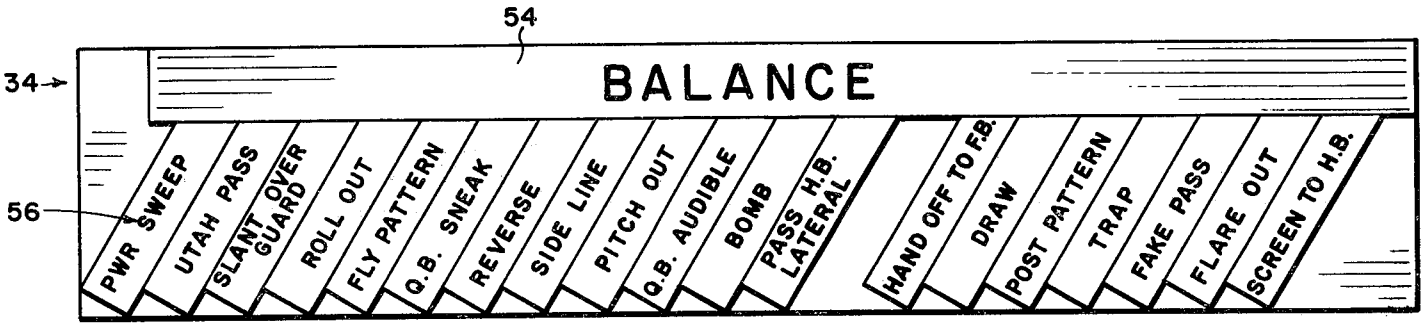
FIG. 4 is a view of another offense style card utilized in a football game embodying the invention.
Figure 5:
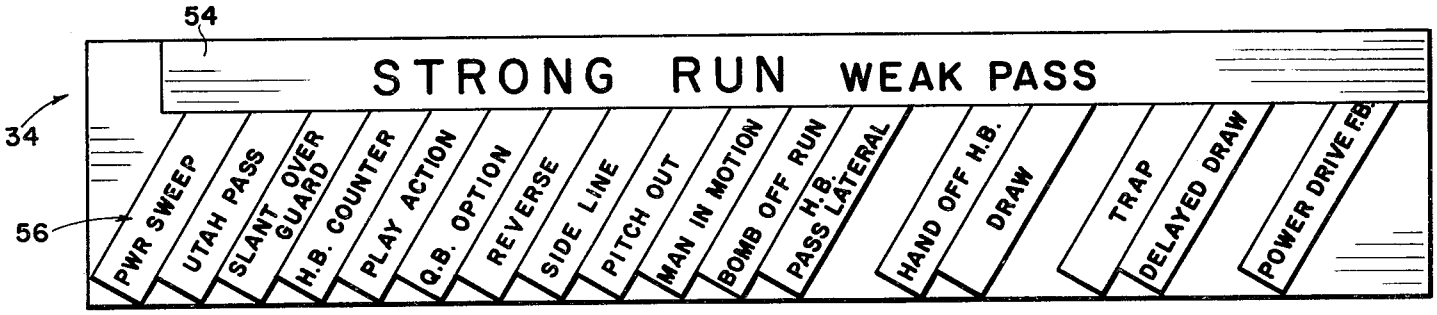
FIG. 5 is a view of still another offense style card utilized in a football game embodying the invention.

The tabulation table 14 is inscribed with tabular columns in both longitudinal and transverse alignment, and as particularly shown in FIG. 2, each of the squares in the columns is provided with suitable indicia which represents the end result of some football play. An area 28 entitled "Defense Style" is defined along one end of the columns, and preferably at the upper end of the longitudinally extending columns as viewed in FIGS. 1 and 2, but not limited thereto. An area 30 entitled "Offense Style" is provided along one side of the transversely extending columns, and preferably the right hand side thereof as shown in the drawings, but not limited thereto, and preferably of a configuration complementary to the configuration of defense style cards generally indicated at 32 (FIGS. 6, 7 and 8) and offense style cards generally indicated at 34 (FIGS. 3, 4 and 5). The defense style cards 32 may be individually placed in the "Defense Style" area 28 and suitably aligned with an appropriate longitudinally extending column of the table 14, as will be hereinafter set forth in detail, and the offense style cards 34 may be individually placed in the "Offense Style" area 30 and suitably aligned with an appropriate transversely extending column of the table 14. The indicia provided at the common point or meeting of the longitudinal column and the transverse column corresponding to the defense style card and offense style card resting in the respective sections 28 and 30 indicates the end result of the play which has been selected by the players of the game, as will be hereinafter set forth. This reading indicates the new position to be taken by the player token as a result of the particular play.

Figure 12:
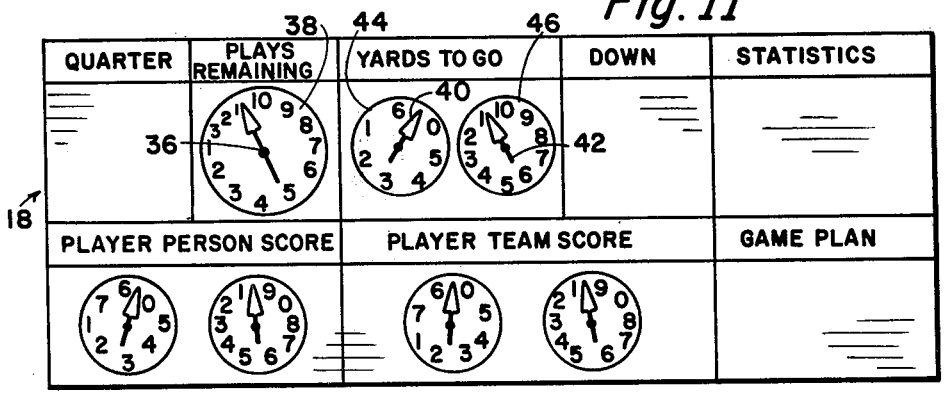
FIG. 12 is a view of a score board portion of a football game embodying the invention.

The scoreboard section 18 is depicted in detail in FIG. 12, and is preferably arranged to provide the scoring and game information normally provided on the score board at a regular football field. One area is provided for keeping track of the downs during the play of the game, as will be seen in FIG. 12, another area is provided for maintaining the number of the downs of the play, and other areas may be provided as desired, as for example an area for the game plan, and statistics, and the like. A pivotal pointer 36 may be provided in combination with a suitable dial 38 for maintaining a record of the plays remaining in the game, a pair of pivotal pointers 40 and 42 may be provided for cooperation with suitable dials 44 and 46, respectively, for indicating the yards to go for obtaining a "first down", and additional pivotal pointers and suitable dials may be provided for maintaining a record of the score of the game when more than one person is playing, or when a single player is playing the game, as will be evident from FIG. 12.

Figure 11:
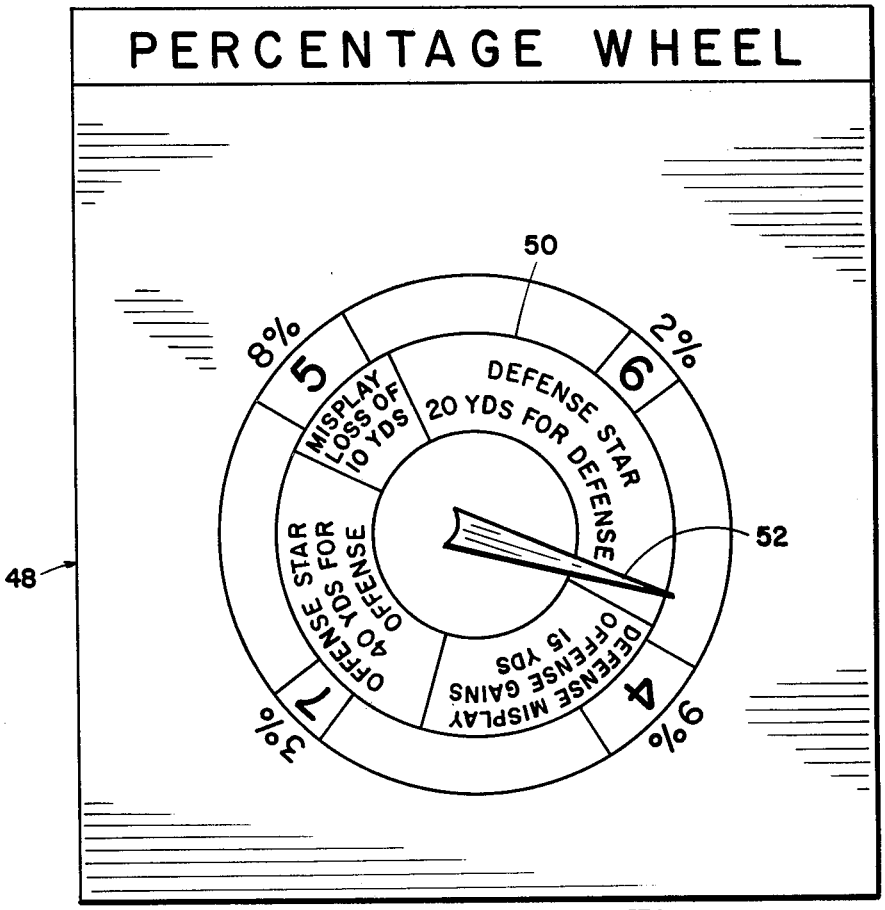
FIG. 11 is a view of a percentage wheel which may be utilized in a football game embodying the invention.

An optional feature 48 (FIG. 11) may be provided in combination with the game board 10, or installed thereon, if desired. The feature 48 is entitled "Percentage Wheel", and includes a circular scale member 50 provided with suitable information inscribed thereon relating to the percentages of success (or failure) of well known plays selected from the statistics of actual football games. This information may be of interest to intense football fans playing the game 10, and who want to test their own play determination skill under various football game conditions with the actual football stars or the like. A pivotal pointer member 52 may be secured to the scale member 50 for facilitating selection of the various percentages, as is well known.

Referring now to FIGS. 3, 4 and 5, typical offense style cards 34 are shown which may be selected by the player according to the offense instruction card he has selected from the offense instruction card pile. The offense style cards 34 are preferably substantially rectangular in configuration and are provided with a main heading 54 identifying a particular type offense play. A plurality of styles 56 falling under this main heading type play are indicated or inscribed on the card 34 with the physical relationship between the position of the styles 56 being substantially angularly disposed with respect to the heading 54.

The particular card 34 shown in FIG. 3 is related to offense plays wherein a strong pass weak run condition exists, and the styles 56 indicated in combination therewith are inscribed on the card 34. During play of the game 10, when this particular card 34 has been selected for an offensive play, the card 34 is physically placed on the offense side or area 30 of the table 14. This will position the various styles 56 in alignment with the transversely extending columns on the table, and the particular column in alignment with the particular style 56 which has been selected will be the column in which the end result of the play will be found, as will be hereinafter set forth.

The particular card 34 shown in FIG. 4 relates to a balance type offensive play, and is provided with styles 56 corresponding thereto. The card 34 shown in FIG. 5 corresponds to a strong run weak pass play situation, and the styles indicated thereon are plays which may be associated with this type play.

Figure 6:
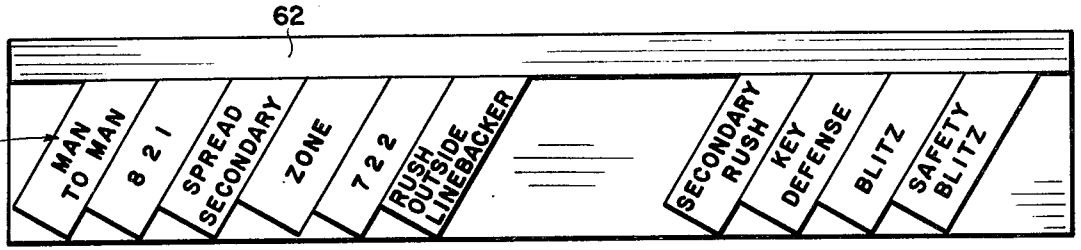
FIG. 6 is a view of a defense style card utilized in a football game embodying the invention.
Figure 7:
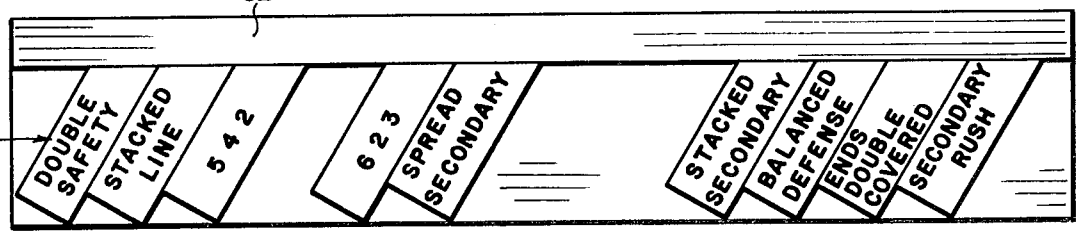
FIG. 7 is a view of another defense style card utilized in a football game embodying the invention.
Figure 8:
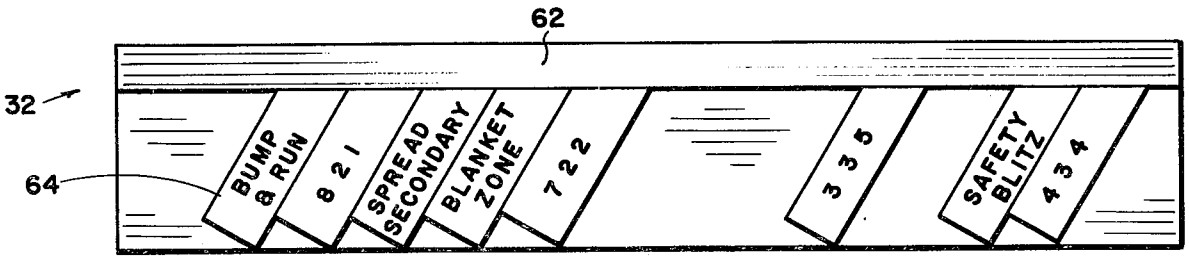
FIG. 8 is a view of still another defense style card utilized in a football game embodying the invention.
Figure 9:
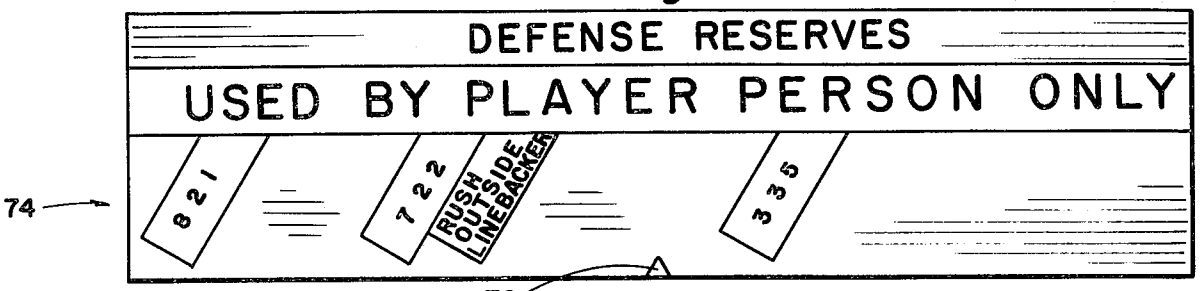
FIG. 9 is a view of a defense style card utilized in a football game embodying, particularly for use during play of the game by a single person only.
Figure 10:
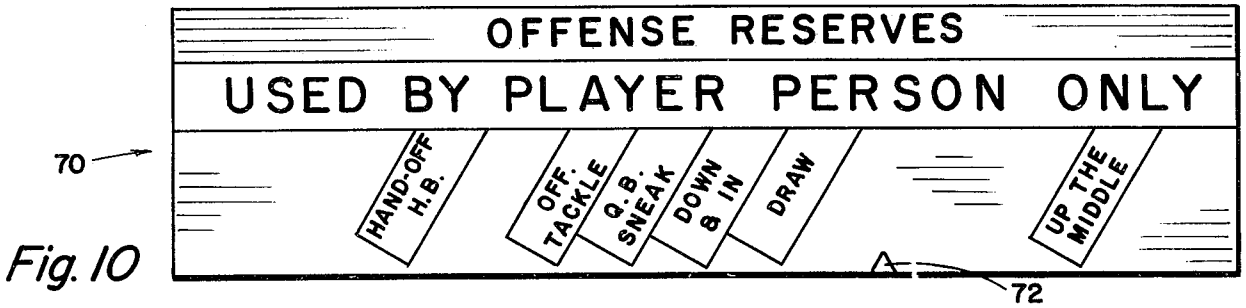
FIG. 10 is a view of another offense style card of the type shown in FIG. 9.

Referring now to FIGS. 6, 7 and 8, defense style cards 32 are shown which may be utilized in the playing of the game. The cards 32 are substantially rectangular in configuration and are provided with a main heading portion 62, and a plurality of play styles 64 inscribed thereon in the same manner as the styles 56. In addition, each card 34 is of a size and configuration substantially corresponding to the space 30 provided on the table 14 and each card 32 is of a size and configuration substantially corresponding to the space 28 for facilitating alignment of the cards with the columns of the table 14 for a purpose and in a manner as will be hereinafter set forth.

Special offense style cards 70, generally similar to the cards 34, are provided for use when a single person is playing the game 10. These cards are also provided with an alignment marking 72 of any suitable type for alignment with a marking 60 provided in the offense area 30 of the table 14. Special defense style cards 74 similar to the cards 32 are also provided with a suitable marking 76 for alignment with a marking 68 provided in the defense area 28 of the table 14. The corresponding markings of the style cards and the tabulation table facilitating the alignment of the play styles on the cards 70 and 74 with the transverse and longitudinally extending columns of the table 14 whereby the cards 70 and 74 may be utilized in the same manner as the cards 32 and 34 as will be hereinafter set forth.

In the playing of the game, and particularly when more than one player is playing the game, offensive strategy for the entire game must be initially determined and adhered to throughout the entire game session. The defense plays are preferably limited to nine specific plays and are pre-printed on the defense instruction cards, thus eliminating an undue advantage for the defensive player. The offensive strategy may be of the player's own design, or the player may rely on the three basic offensive styles offered on the pre-printed offense instruction cards provided with the game. Whatever is initially selected must remain in force throughout the game play period. In addition, before actual game play has begun, a decision must be made as to whether or not the percentage wheel 48 is to be used. If a decision is made to use the wheel 48, then the spinner 52 must be manually pivoted or otherwise spun about subsequent to each third down play and the players must abide by the results indicated at the stop of the spinner. Additionally, the wheel must be used at each third down play throughout the playing of the game. If the decision is made to omit the use of the wheel 48, then the wheel 48 cannot be used for any play during the game.

The offensive plays for the game are limited in number to the total number of plays per game, asfor example fourteen plays per team. Accordingly, the fourteen plays are individually recorded on blank cards (not shown) if the player has decided to use his own strategy, and the cards are shuffled and placed face down in a pile on the game board 10 at the properly designed position. Of course, if the player elects to use the pre-printed instruction cards provided with the game, these cards are shuffled and placed face down in a pile on the game board. The offense instruction cards are shuffled only once during the game, and that being at the beginning of the game. The pre-printed defense instruction cards are shuffled and placed in two piles on the game board, face down, with those defense plays normally utilized against a passing offense being placed in one pile, and those plays utilized against a regular offense being placed in a second pile. The defense instruction cards are reshuffled after each series of plays.

A die is then cast to determine which player starts first. The winner of the "toss" may select whether he wishes to be on defense or offense, and of course, the player on offense places his player token on an appropriate position on the playing field section 12 of the board 10.

The player representing the team on offense selects the top card of the offense instruction cards, and notes the game play printed thereon. The appropriate offense style card representing the instructions on the selected play card is then selected and placed in the area 30 on the table 14. The size and configuration of the card corresponds with the size and configuration of the area 30, and the card is placed so as to substantially completely cover the area 30. This places the indicia printed on the card in alignment with the transversely extending columns of the table 14, with particular attention being directed to the column in alignment with the indicia representing the selected offense play.

The defense player selects either the top card of the regular defense pile or the top card of the pass defense pile, as he desired, and notes the instructions thereon. He then selects the defense style card representing the instructions on the play card and places the style card in the area 28 on the table 14. The size and configuration of the card corresponds with the size and configuration of the area 28, and the card is placed so as to substantially completely cover the area 28. This places the indicia printed on the card in alignment with the longitudinally extending columns of the table 14, with particular attention being directed to the column in alignment with the indicia representing the selected defense play. The intersection of the transverse column in alignment with the offense play and the longitudinal column in alignment with the defense play will provide a direct reading of the end result of the combination of the two, thus providing a result for the play. The player token is then repositioned on the football field 12 of the game board in accordance with the play result, as would be the case in an actual football game.

In the event the decision at the initiation of the playing of the game was made to use the percentage wheel 48, the spinner 52 utilized at the completion of each third down play, and the end result of that third down play is read or determined by the stopping position of the spinner. In other words, the spinner action takes the place of the fourth down play. Of course, if the decision at the initiation of the playing of the game was made to omit the use of the percentage wheel 48, then the fourth down is completed in the usual manner when required for each series of plays as in the playing of an actual football game. Certain exceptions may be provided, if desired, and may be set forth in an instruction booklet (not shown) which may accompany the game for clarification of the playing of the game, particularly for a novice player.

The various indicators provided on the scoreboard section 18 may be manually manipulated in the usual manner for indicating the conditions of the game after each play in much the same manner as the scoreboard is maintained during a football game of the usual outdoor type.

Of course, if a team is unable to make ten yards in four tries (downs), the ball must be punted away, with any particular instructions for doing so included in the instruction booklet, if desired. The other player then becomes the offensive player, and the routines are repeated throughout the playing of the game until the final play is played, and the player having the greatest number of points at the end of the game is the winner. The scoring of points during the game play is substantially identical with the scoring of an actual football game.

When a single player is playing the game, of course the limitations of the pre-printed cards may be completely eliminated, if desired, with the exception of the offense style cards and the defense style cards. In this event the opposing team is represented by the pre-printed instruction cards, the manipulation of which is accomplished by the single or individual players. The single player may use his own ingenuity at great length, thus providing many hours of entertaining passtime for the individual player.

As hereinbefore set forth, a variety of printed rules may accompany the game 10, if desired, to add variety and excitement to the playing of the game. For example, certain penalties may be provided for additional game interest, or certain advantages may be achieved during the play. In addition, a statement of definitions may accompany the game for facilitating understanding of the game ramifications of the play, particularly for those persons who may be somewhat less familiar with the intrigue and strategy of actual football play. The essential feature of the game remains the resemblance thereto of the actual game of football as played in the out of dorrs or on an actual football field.

The play of the game is substantially as hereinbefore set forth, and the governing rules of the game relating to penalties, numbers of plays per quarter, etc. preferably accompany the game as hereinbefore set forth, and whereas one particular set of comprehensive rules for the game may be preferred, it will be apparent that substantially any rules may be developed or provided for the game as long as the overall play of the game closely resembles the actual game of football, whether an individual player is utilizing the game or more than one player is playing the game.

From the foregoing it will be apparent that the present invention provides a novel board-type game simultating the game of football as actually played on a football field. The game is provided with a football field inscribed thereon generally similar to an actual physical football field, and the play of the game closely resembles an actual football game, requires great skill and provides many hours of entertainment. The game may be played with equal enjoyment by one or more players.

Whereas the present invention has been described in particular relation to the drawings attached hereto, it should be understood that other and further modifications, apart from those shown or suggested herein may be made within the spirit and scope of this invention.

What is claimed is:

1. A board-type football game comprising a game board having a football field inscribed thereon, a play result tabulation table inscribed on the game board, a plurality of offense style cards adapted to be selectively positioned in combination with the play result tabulation table, a plurality of defense style cards adapted to be selectively positioned in combination with the play result tabulation table for cooperation with the table and the offense style cards to determine the end result of the individual plays during the playing of the game whereby the overall play of the game closely resembles an actual football game.

2. A board-type football game as set forth in claim 1 and including indications inscribed on the game board for defining positions for play instruction cards which may be selectively utilized for the individual plays of the game.

3. A board-type football game as set forth in claim 1 wherein alignment markings are provided on the offense style cards for alignment with complementary markings provided on the play result tabulation table for facilitating the determination of the end result of each individual play during the playing of the game.

4. A board-type football game as set forth in claim 1 wherein alignment markings are provided on the defense style cards for alignment with complementary markings provided on the play result tabulation table for facilitating the determination of the end result of each individual play during the playing of the game.

5. A board-type football game as set forth in claim 1 wherein first and second alignment markings are provided on the play result tabulation table, each offense style card is provided with a marking adapted for alignment with one of said alignment markings, and each defense style card is provided with a marking adapted for alignment with the other of said alignment markings all for cooperating to provide a determination of the end result of each individual play during the playing of the game.

6. A board-type football game as set forth in claim 1 and including a scoreboard inscribed on said board for facilitating the scoring of the game in a manner simulating the scoring of an actual football game.

7. A board-type football game as set forth in claim 6 wherein said scoreboard includes a plurality of circular-type scales cooperating with pivotal indicator members for maintaining a running accounting of the scoring of the game in the manner of the scoring of an actual football game.

8. A board-type football game as set forth in claim 1 and including a percentage wheel for determination of play performance percentages compared with similar performances during actual football games.

9. A board-type football game as set forth in claim 1 wherein the offense style cards are of a size and configuration complementary to markings on the tabulation table for facilitating the determination of the end result of each individual play during the playing of the game.

10. A board-type football game as set forth in claim 1 wherein the defense style cards are of a size and fongiguration complementary to markings on the tabulation table for facilitating the determination of the end result of each individual play during the playing of the game.

* * * * *